US011952792B2

(12) United States Patent
Bernabeo et al.

(10) Patent No.: US 11,952,792 B2
(45) Date of Patent: Apr. 9, 2024

(54) PORTABLE BEACH POLE

(71) Applicants: Suzanne Agnes Bernabeo, Flushing, NY (US); Louis Vincent Natoli, Richmond Hill, NY (US)

(72) Inventors: Suzanne Agnes Bernabeo, Flushing, NY (US); Louis Vincent Natoli, Richmond Hill, NY (US)

( * ) Notice: Subject to any disclaimer, the term of this patent is extended or adjusted under 35 U.S.C. 154(b) by 104 days.

(21) Appl. No.: 17/412,055

(22) Filed: Aug. 25, 2021

(65) Prior Publication Data

US 2022/0243490 A1 Aug. 4, 2022

Related U.S. Application Data

(60) Provisional application No. 63/145,016, filed on Feb. 3, 2021.

(51) Int. Cl.

| | |
|---|---|
| ***E04H 12/22*** | (2006.01) |
| ***A45F 4/00*** | (2006.01) |
| ***A45F 5/00*** | (2006.01) |
| ***A47G 25/06*** | (2006.01) |
| ***E04H 12/02*** | (2006.01) |
| *A45F 3/44* | (2006.01) |

(52) U.S. Cl.

CPC ..... *E04H 12/2238* (2013.01); *A45F 4/00* (2013.01); *A45F 5/00* (2013.01); *A47G 25/0664* (2013.01); *E04H 12/02* (2013.01); *A45F 3/44* (2013.01); *A45F 2004/003* (2013.01); *E04H 12/2253* (2013.01); *E04H 12/2269* (2013.01)

(58) Field of Classification Search

CPC ..... A45F 3/44; A45F 2200/05; A45F 4/00; A45F 5/00; A45F 2004/003; A47F 5/04; A47F 5/13; A47F 5/06; A47G 25/0664; A47G 7/041; A47G 7/044; E04H 12/2238; E04H 12/02; E04H 12/2269; E04H 12/2253

USPC ..... 248/519

See application file for complete search history.

(56) References Cited

U.S. PATENT DOCUMENTS

| | | | | | |
|---|---|---|---|---|---|
| 1,069,643 | A * | 8/1913 | Inden | A47F 5/06 | 211/172 |
| 2,277,332 | A * | 3/1942 | Lamb | A47G 25/0664 | 211/171 |
| 3,547,275 | A * | 12/1970 | Engel | A47F 5/13 | 211/205 |

(Continued)

FOREIGN PATENT DOCUMENTS

| | | | | |
|---|---|---|---|---|
| DE | 10129578 C1 * | 9/2002 | ..... | A45B 19/08 |
| KR | 20070077144 A * | 7/2007 | ..... | A45B 25/06 |
| WO | WO-2016138426 A1 * | 9/2016 | ..... | B64G 1/10 |

*Primary Examiner* — Taylor Morris

(57) ABSTRACT

A portable beach pole consists of a pole and a support base. The support base can be separated from the pole, and the pole itself can be separated into two or more pole pieces along its length, so that the support base and pole pieces can be easily transported from home to car to beach, in a bag. One or more of the pole pieces includes integral hooks from which wet beach towels, clothing and other items such as toys, food/beverage bags and beach bags may be hung. The pole pieces and support base can be quickly assembled into the beach pole, whereby the beach pole can be just as quickly disassembled. The support base provides a sturdy and secure structure for maintaining the beach pole vertical and in place.

11 Claims, 10 Drawing Sheets

(56) References Cited

U.S. PATENT DOCUMENTS 3,638,814 A * 2/1972 Lowery ..... A47F 5/13 248/165
4,576,350 A * 3/1986 Bond ..... B65B 67/12 248/97
4,786,053 A * 11/1988 Barnes, Jr. ..... A63B 71/023 273/400
5,417,438 A * 5/1995 Poff ..... A63B 71/02 362/431
5,876,011 A * 3/1999 Blasing ..... F16M 11/046 403/109.1
6,296,581 B1 * 10/2001 Sever ..... A63B 47/002 473/422
6,612,320 B2 * 9/2003 Lin ..... A45B 25/22 135/33.7
6,702,129 B1 * 3/2004 Harris ..... A47G 25/0664 211/172
6,732,985 B1 * 5/2004 Cantrell ..... A45F 3/44 248/156
6,895,982 B1 * 5/2005 Shaw ..... E04H 12/2246 135/16
7,273,198 B2 * 9/2007 Tourtellotte ..... E04H 12/2238 248/166
7,475,859 B2 * 1/2009 Selders ..... F16B 45/00 248/304
7,980,520 B2 * 7/2011 Taylor ..... A45F 3/44 248/527
8,162,320 B2 * 4/2012 Medina ..... F41J 1/10 273/410
8,388,462 B1 * 3/2013 Dagley ..... A63B 21/4003 473/274
9,603,469 B2 * 3/2017 Lapointe ..... A47F 5/04
10,244,852 B1 * 4/2019 Donaldson ..... E04H 12/182
10,729,226 B1 * 8/2020 Zamora ..... A45F 3/44
10,966,508 B2 * 4/2021 Fordyce ..... A45F 3/44
11,561,072 B1 * 1/2023 Larsen ..... G09F 15/0068
11,737,549 B2 * 8/2023 Cruickshank ..... A47G 23/0225 220/8
2004/0149867 A1 * 8/2004 Johnson ..... F41B 5/1453 248/146
2006/0011787 A1 * 1/2006 Law ..... A47J 37/0786 248/121
2010/0057017 A1 * 3/2010 Pappas ..... A61M 5/1417 604/257
2012/0055893 A1 * 3/2012 Wisniewski ..... A47G 25/0664 211/85.3
2012/0084994 A1 * 4/2012 Alston ..... D06F 58/203 34/90
2014/0054529 A1 * 2/2014 Whiteley ..... E01F 9/692 256/31
2014/0305348 A1 * 10/2014 Vasquez ..... A47B 37/04 211/13.1
2014/0332644 A1 * 11/2014 Davis ..... A45F 3/44 248/146
2015/0083678 A1 * 3/2015 Baughman ..... A47F 5/04 211/85.3
2015/0230634 A1 * 8/2015 Christlieb ..... A47G 7/044 248/200
2017/0021254 A1 * 1/2017 Wolf ..... A63B 67/06
2021/0022483 A1 * 1/2021 Saunders ..... A45C 3/10
2023/0407663 A1 * 12/2023 Lu ..... E04H 15/44

* cited by examiner

PORTABLE BEACH POLE

BACKGROUND OF THE INVENTION

A day at the beach should be a relaxing and stress-free occasion to enjoy sun, sand, and saltwater swimming, with family and friends. However, at times the sand and salt water can make towels, clothing, and other items such as toys, food/beverage bags and beach bags heavy and messy making it a nuisance and can be intrinsically large or heavy. When people sit close to the shore and the tide comes up, these items can become messy, wet and sandy when people are not fast enough to pick everything up in time. Shirts, shorts, and cover-ups are taken off at the beach and thrown down on a blanket, cooler or draped over a beach chair which slip off or get knocked down in the sand. Often when wet towels are not in use, they are dropped down in the same way and end up in the sand. The last thing anyone wants is to repeatedly pick up and shake off wet, sandy clothes and towels, taking time away from activities on the beach. When re-using an already wet and sandy towel after a swim, that towel gets draped back onto the beach chair getting sat on, never getting a chance to dry.

There are hooks to attach to conventional beach umbrellas to hold wet and heavy towels and clothing, making the beach umbrella unsteady, becoming dislodged, fall, or tip over, which can become a hazard.

There is a need for a sturdy, easily transportable and convenient structure for holding items such as clothing, heavy wet towels, and other items such as toys, food/beverage bags and beach bags when they are not in use. Such a structure would not require much great physical strength, heavy lifting, digging in the sand, or any tools. This structure would be designed to withstand environmental conditions and not corrode over time due to sand moisture, sand texture, or other elements. Such a structure that can be used to prevent clothing, heavy wet towels, food/beverage bags and beach bags from getting overly sandy. The present invention is embodied in an advantageous and useful structure that provides a solution to the identified problems.

SUMMARY OF THE INVENTION

The present invention is embodied in accordance with these principles to provide a support structure to support clothing, towels, and other items such as toys and food/beverage bags and beach bags, that need to be hung away from the sand and saltwater.

A novel and advantageous beach pole consists of a pole, and a support base. The support base can be separated from the pole, and the pole itself can be separated into two or more pole pieces along its length, so that the support base and pole pieces can be easily transported in a bag to the beach. One or more of the pole pieces includes integral hooks from which clothes, towels, or other items such as toys, food/beverage bags and beach bags, may be hung. The pole pieces and the support base are made of PVC or other material that can resist sand and saltwater and is light enough for easy carrying. The pole pieces and support base can be quickly assembled into the beach pole using mating adaptors, e.g., threaded adaptors, whereby the beach pole can be just as quickly disassembled.

According to one aspect of the invention, a support pole comprises a pole, the pole having a longitudinal length that is separable into a plurality of successive pole pieces in order along the length, including at least an upper pole piece and a lower pole piece, wherein the pole can be assembled by connecting the plurality of successive pole pieces in order from the upper pole piece to the lower pole piece, a plurality of hooks connected to the pole and extending outward therefrom, the hooks being adapted to receive and support individual loads, and a support base, the support base being releasably connected to the lower pole piece, the support base presenting a substantially flat lower surface, wherein, when the pole is assembled by connecting the plurality of successive pole pieces in order and when the support base is connected to the lower pole piece, the support pole is standable with the lower flat surface resting on an external horizontal flat surface.

According to another aspect of the invention, the pole and the support base are constructed from a material resistant to corrosion from sand and salt.

According to another aspect of the invention, the material is PVC piping.

According to another aspect of the invention, the longitudinal length is approximately six feet long.

According to another aspect of the invention, the upper and lower pieces are of approximately equal length.

According to another aspect of the invention, the hooks are connected to the upper pole piece. However, the hooks may be connected to one or more lower pole pieces or to both upper and lower pole pieces.

According to another aspect of the invention, the upper pole piece is releasably connected to an adjacent pole piece by a threaded fitting.

According to another aspect of the invention, the lower pole piece is releasably connected to an adjacent pole piece by a threaded fitting.

According to another aspect of the invention, a total weight of the support pole may advantageously be approximately 7.5 pounds, such that the support pole is light enough to be transportable by a single person.

According to another aspect of the invention, each pole piece has a length of approximately three feet.

According to another aspect of the invention, materials of the pole and the support base are selected in conjunction with a size of each of the pole and the support base such that the support pole stands sturdily erect on the support base when assembled.

According to another aspect of the invention, materials of the pole and the support base are selected in conjunction with a size of each of the pole and the support base and in conjunction with an anticipated load such that said support pole stands sturdily erect on the support base when assembled and bearing the load.

According to another aspect of the invention, each hook may hold up approximately 30 pounds. Moreover, the hooks may be distributed around the pole so as to enable the balancing of an anticipated load, formed for example of clothing, wet beach towels, and/or other items such as toys, food/beverage bags, and beach bags, hanging from each of the hooks.

According to another aspect of the invention, wherein, when the pole is assembled by connecting the plurality of successive pole pieces in order and when the support base is connected to the lower pole piece, the support pole is standable with the lower flat surface resting on an external horizontal flat surface, for example, sand, a boat surface, a deck or on concrete, etc.

DETAILED DESCRIPTION OF THE INVENTION

Figure 1A:
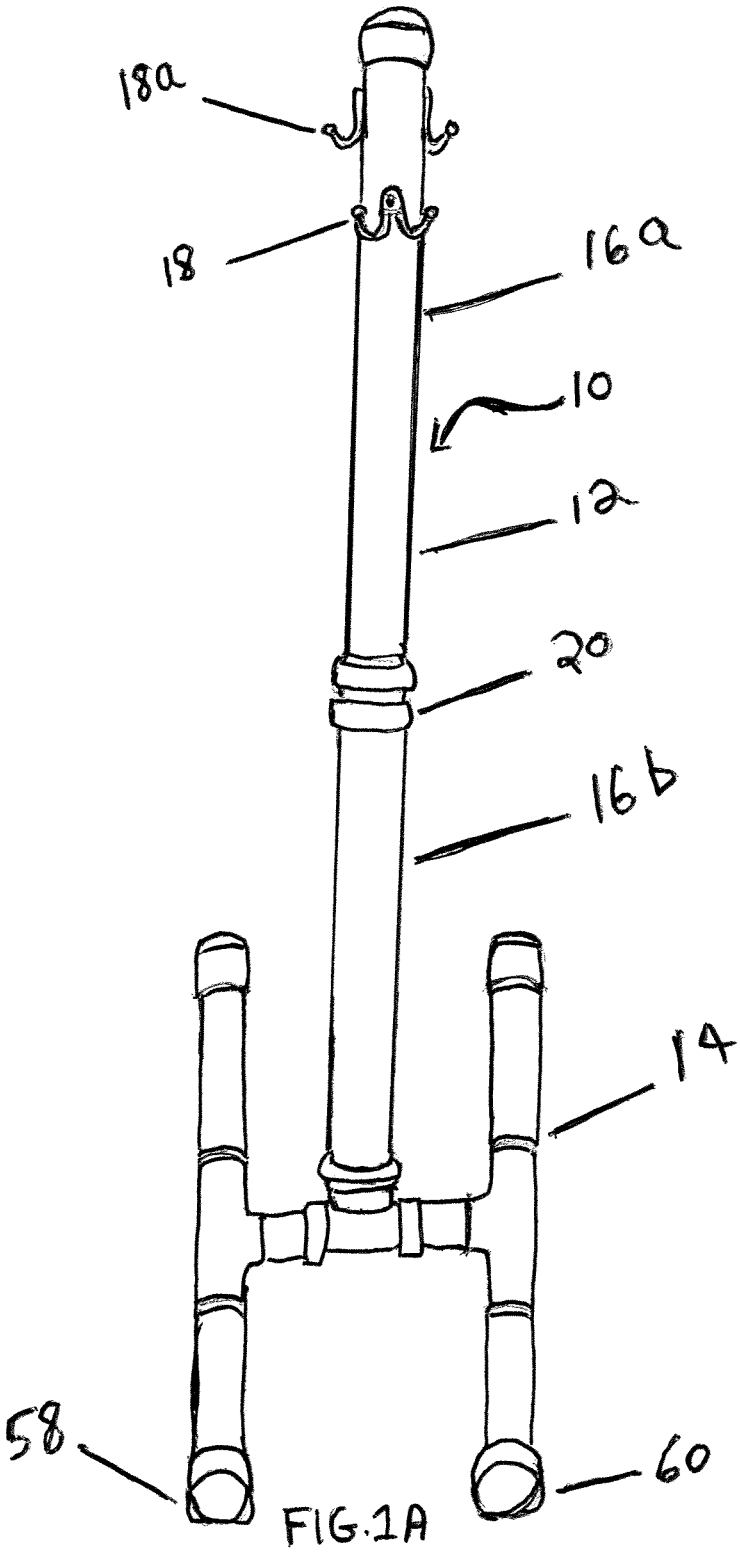
FIG. 1A is an elevational view of the assembled beach pole, including the pole and support base.
Figure 1B:
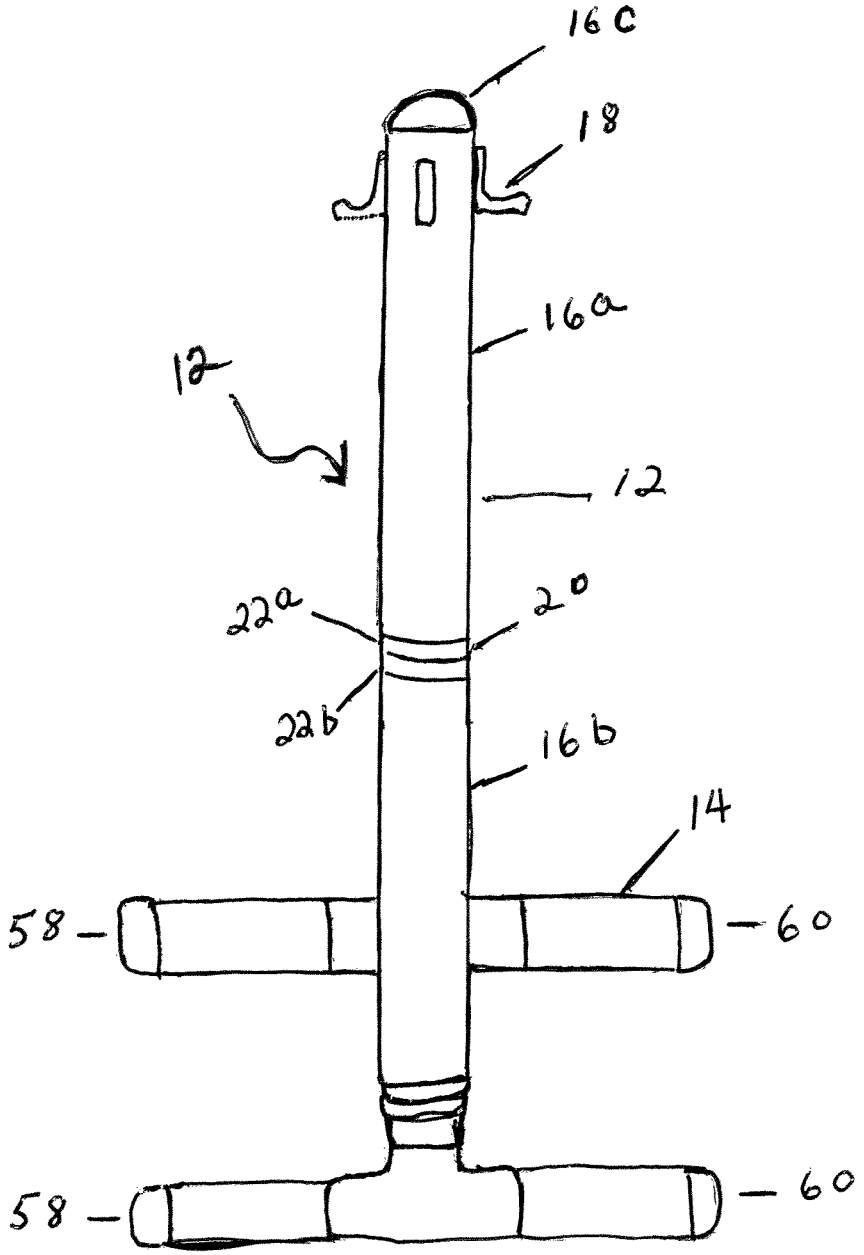
FIG. 1B is a second elevational view of the assembled beach pole, including the pole and the support base.
Figure 1C:
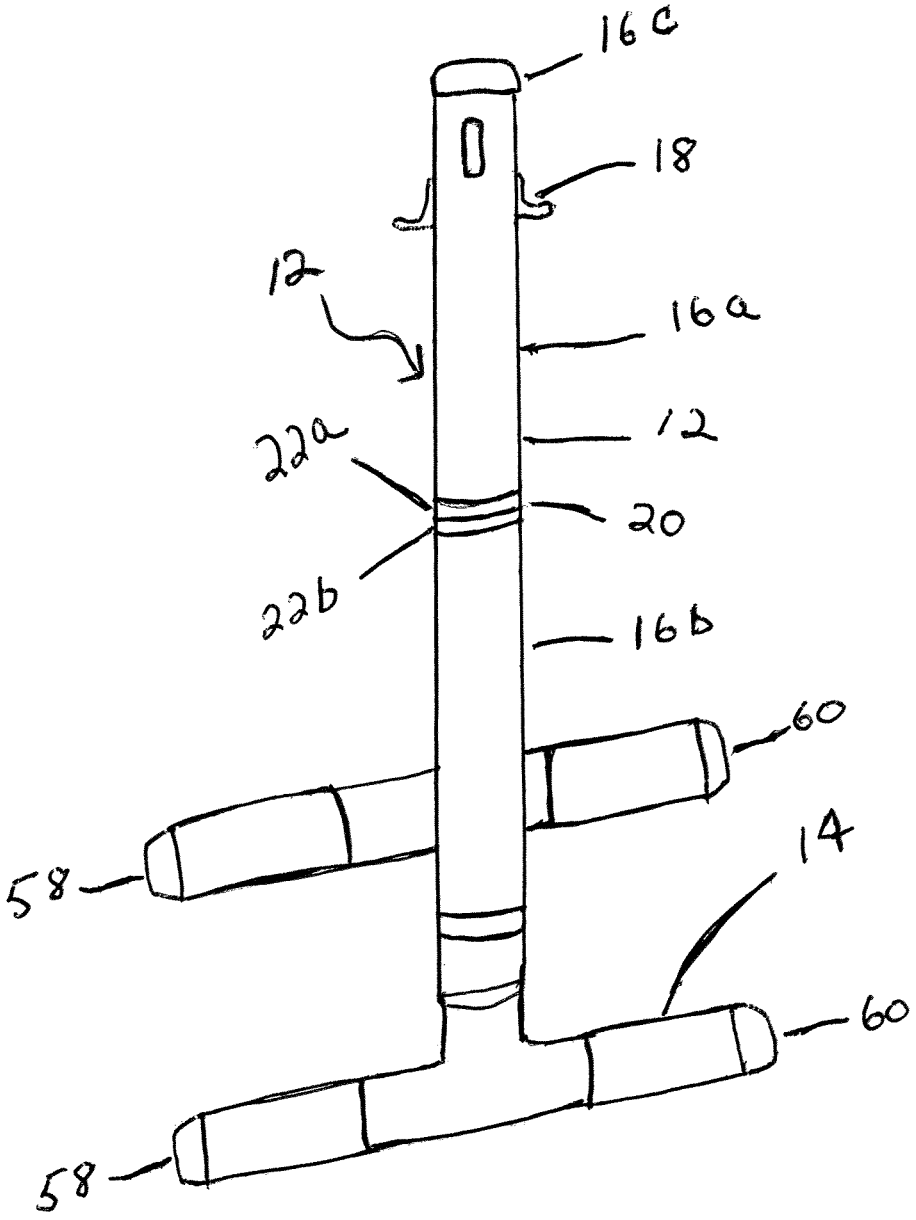
FIG. 1C is a third elevational view of the assembled beach pole, including the pole and the support base.

FIGS. 1A-C is an elevational view of the preferred embodiment of the invention in the form of an assembled beach pole 10, including a pole 12 and a support base 14. The beach pole 10 functions as a lightweight support structure for clothes, towels, and other items such as toys, food/beverage bags and beach bags. The pole 12 is formed of a plurality of pieces, which in this embodiment are upper piece 16*a* and lower piece 16*b*.

The upper piece 16*a* and lower piece 16*b* are advantageously made of PVC piping to withstand corrosion from sand moisture, sand texture, saltwater and other elements. Other materials may be used, such as metal (e.g., aluminum), plastics, or ceramics, provided that they are sufficiently weather resistant and sufficiently lightweight to be easily transportable. The material used should be sufficiently light that the weight of all of the parts of the beach pole together may be easy to carry by one person, but strong enough to support the expected weight of beach paraphernalia.

Figure 1D:
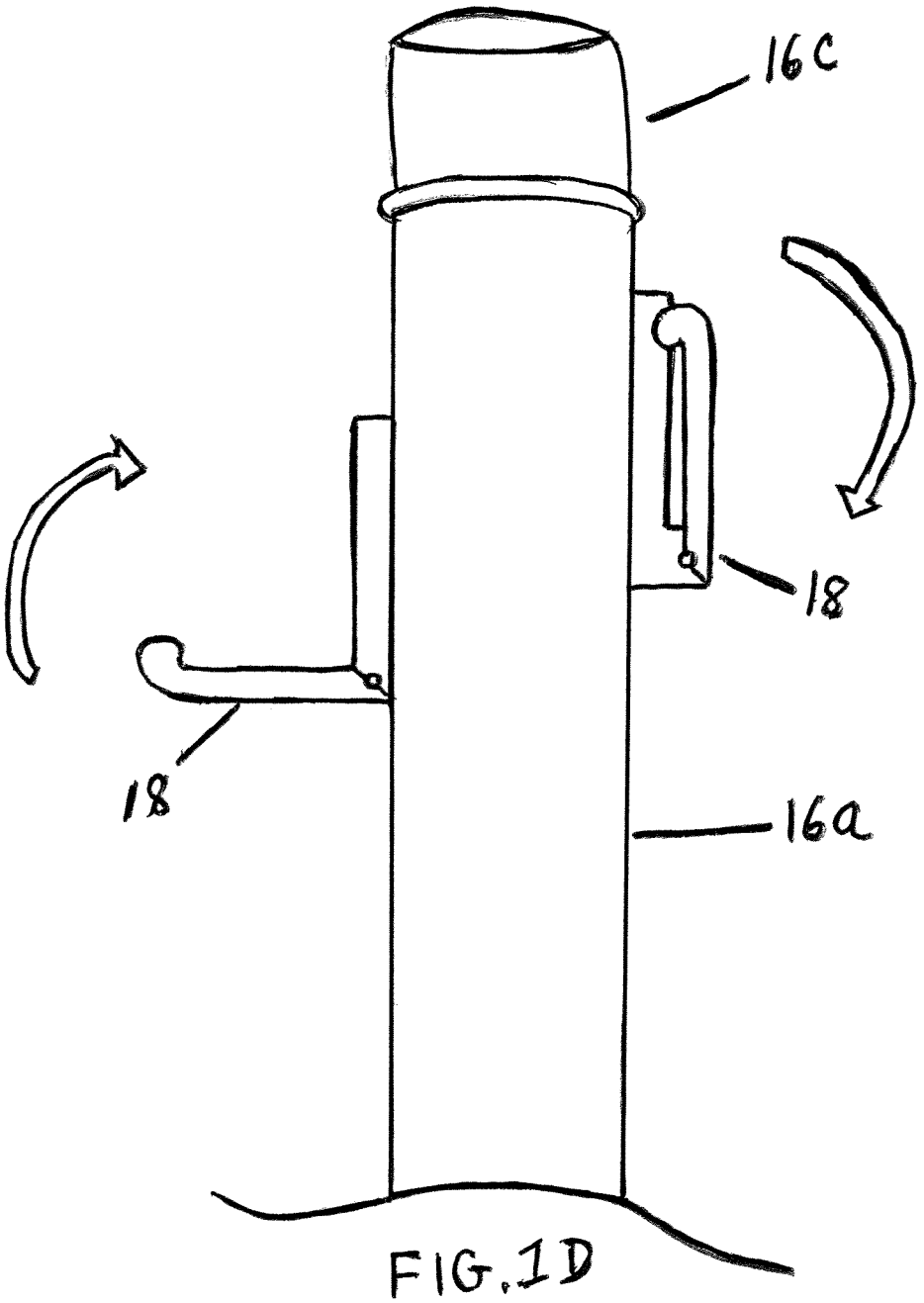
FIG. 1D is an elevational view of the upper pole piece of the assembled beach pole, including foldable hooks.

As shown in FIGS. 1A-C, 2, 3, the upper piece 16*a* is in the form of a cylindrical hollow pipe having a uniform inner diameter and uniform outer diameter. The upper piece 16*a* carries a plurality of hooks 18 each with prongs 18*a*, on its outer surface, which are advantageously integral with the upper piece 16*a*. As also shown in FIG. 1D, the hooks 18 are advantageously set at a particular level on the upper piece 16*a* and are symmetrically spaced around the circumference of the upper piece 16*a* to enable items to be hung in a balanced fashion to avoid tipping over the beach pole 10. For example, four hooks 18 may be provided. As another example, two or more vertically spaced rows or hooks 18 may be provided. The level is set so that, when the beach pole 10 is assembled, the hooks 18 are at a height from the ground that is easily accessible to people, but not so close to the ground that clothing, towels and other items such as toys and food/beverage bags and beach bags, hung from the hooks 18 are likely to trail on the ground. For example, if each of the upper and lower pieces 16*a*, 16*b* is approximately three feet long, then a row of hooks 18 may be situated 4 inches below the top of the upper piece 16*a*. Each hook, 18 may include one or more prongs 18*a* to provide additional hanging options. The prongs 18*a* may also be arranged symmetrically. The hooks 18 may advantageously be made of plastic, metal, ceramic or other strong and weather resistant material and may also be foldable. The hooks 18 may be permanently fixed in position extending outwardly from the circular perimeter of the upper piece 16*a*. Alternatively, as shown in FIG. 1D, the hooks 18 may be foldable to rest within the upper piece 16*a* for storage and to be actuated to extend out of the upper piece 16*a* to engage objects to hang therefrom. After use and for storage or transport, the hooks 18 may be returned to rest against or within the upper piece 16*a*. The foldable hook 18 may have a hinge designed to hold the foldable hook in either its open or closed position or alternatively a mechanism can be provided within the upper piece 16*a* to hold the hooks 18 inside during storage, thereby avoiding a hazard of having a hook extending outwardly from a pole piece when it is not in use. The upper piece 16*a* has a cap 16*c*, advantageously made of the same material as the upper piece 16*a*, e.g., PVC, to close off the top of the upper piece 16*a*.

As shown in FIGS. 1A-C, 2, 3, the lower piece 16*b* is also in the form of a cylindrical hollow pipe having a uniform inner diameter and a uniform outer diameter that match the upper piece 16*a*. When the beach pole 10 is assembled, the upper piece 16*a* and the lower piece 16*b* form a cylindrical structure extending, for example, for approximately 6 feet or more. In this embodiment, each of the upper piece 16*a* and the lower piece 16*b* are approximately 3 feet long. In other embodiments, the upper piece 16*a* and the lower piece 16*b* may have different lengths. In other embodiments, the beach pole 10 may be divided more than two pieces. In still other embodiments, the total length of the assembled beach pole 10 may be different.

Figure 2:
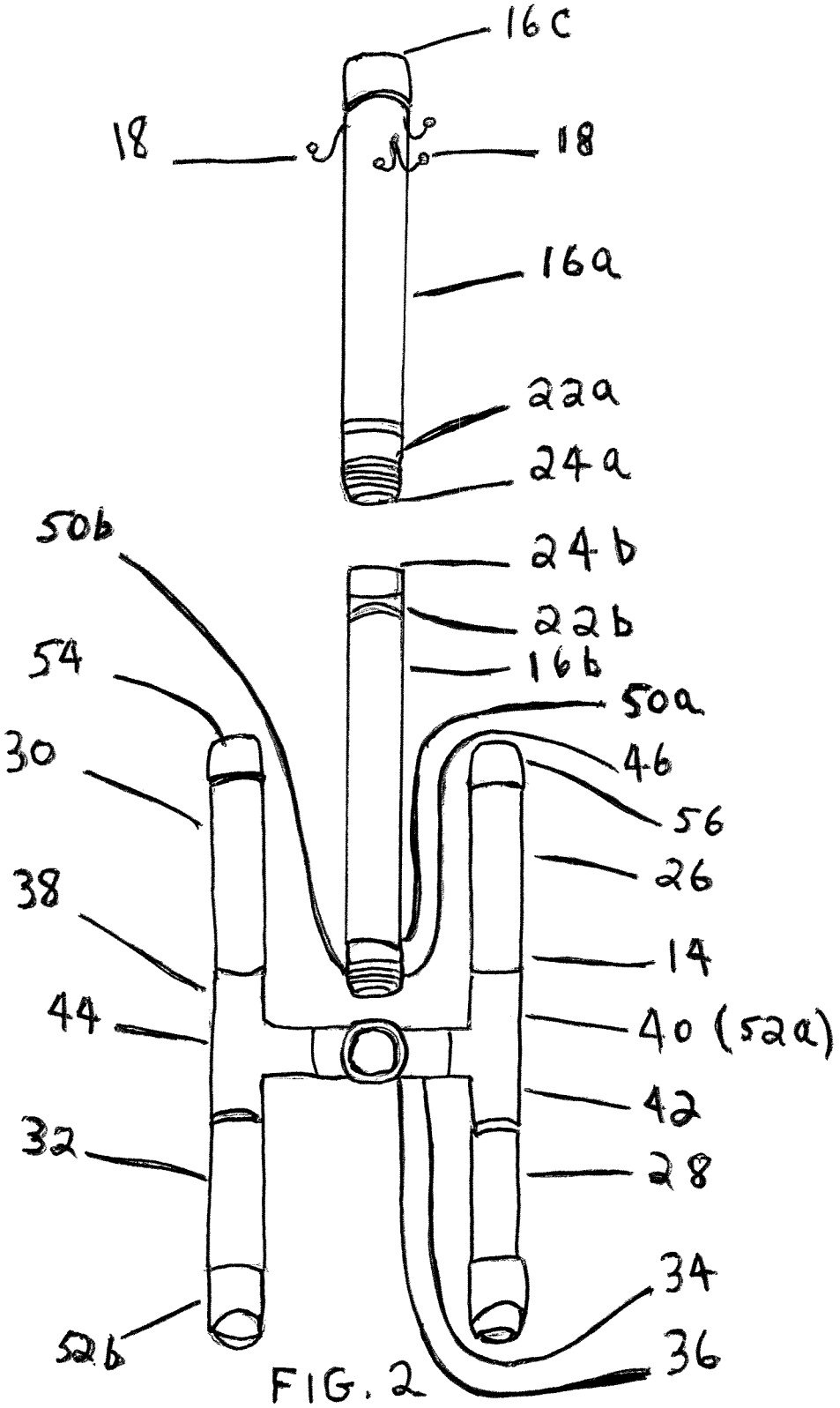
FIG. 2 is an elevational view of the disassembled beach pole, including the pole and support base.
Figure 3:
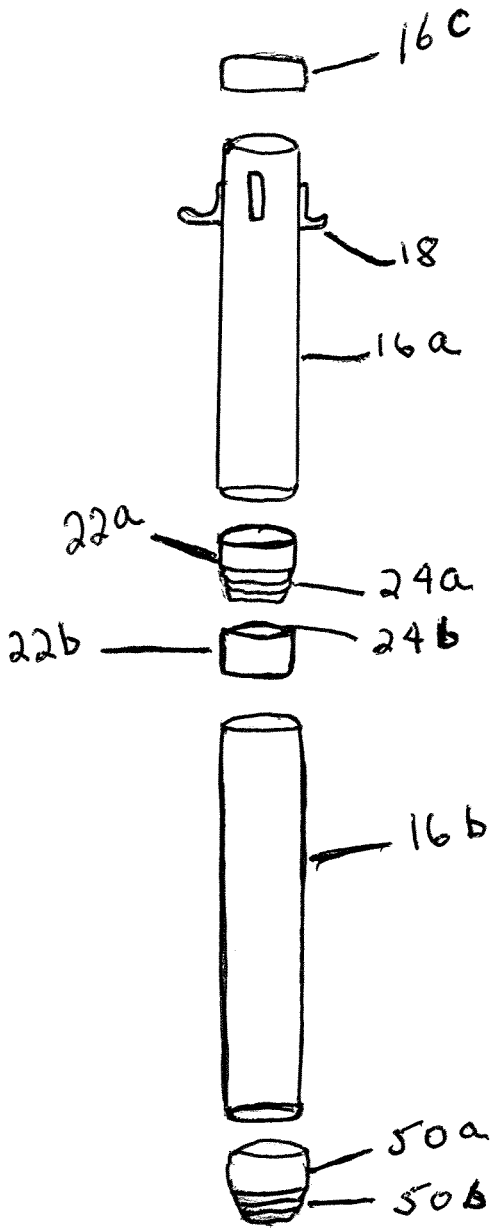
FIG. 3 is an elevational view of the disassembled pole.
Figure 4:
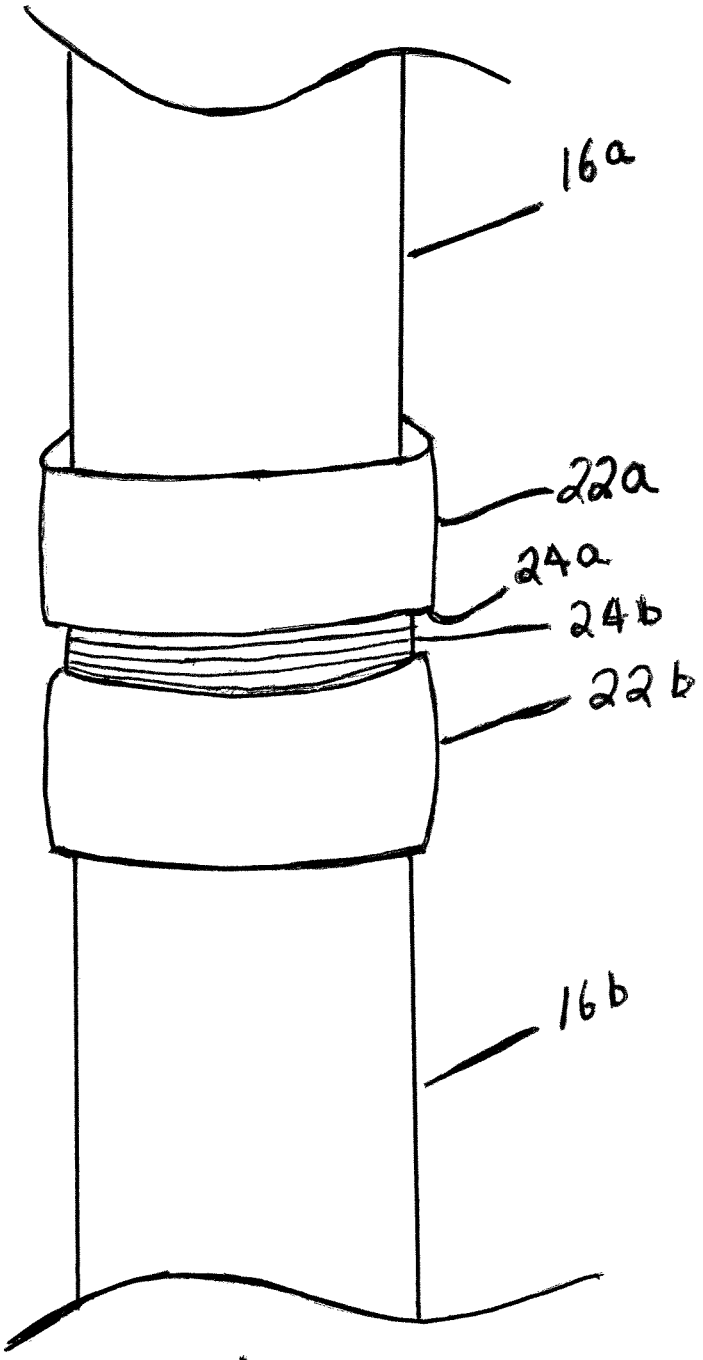
FIG. 4 is a plan view of the mating adaptors on the pole.

As shown in FIGS. 2, 3, 4, the upper piece 16*a* is connectable to the lower piece 16*b* through a mating adaptor 20 constituted by an upper adaptor 22*a* on the upper piece 16*a* and a lower adaptor 22*b* on the lower piece 16*b*. In the example shown in FIGS. 2, 3, the upper adaptor 22*a* is a male adaptor and the lower adaptor 22*b* is a female adaptor. The upper adaptor 22*a* is designed to be threaded into the lower adaptor 22*b* for easy assembly and disassembly. In particular, the upper adaptor 22*a* includes an external threaded fitting 24*a* and the lower adaptor 22*b* includes an internal threaded fitting 24*b*. The upper fitting 24*a* is sized to thread securely within the lower fitting 24*b* to establish a strong and secure connection of upper piece 16*a* and lower piece 16*b* when the beach pole 10 is assembled. The upper and lower pieces 16*a*, 16*b* may be correspondingly separated when the beach pole 10 is disassembled. The adaptors 22*a*, 22*b* are made of PVC piping. Alternatively, the adaptors 22*a*, 22*b* may be made of other materials suitably weather resistant and lightweight. The fittings 24*a*, 24*b* may be made of, e.g., plastic.

As shown in FIGS. 2, 5A-B, 6, the support base 14 is advantageously made of the same piping material as the pole pieces 16*a*, 16*b*. As shown in FIGS. 2, 5A-B, 6, the support base 14 is designed in the shape of an "H". Each side is formed of two parallel support parts 26, 28 and 30, 32, respectively. A central support piece 34 is formed of two support parts 36, 38 permanently connected by a T adaptor 40. One end of the central support piece 34 is permanently attached perpendicular to the support parts 26, 28 at their midpoint with a T adaptor 42, and the other end of central support piece 34 is also permanently attached perpendicular to the support parts 30, 32 at their midpoint with a T adaptor 44 and the other end of central support piece 34 is also permanently attached perpendicular to the support parts 30, 32 at their midpoint with a T adaptor 44. The support parts 26-32, 36-38 are designed such that, when assembled they lie substantially flat on a substantially flat surface, e.g., the beach, a deck, a boat, concrete, etc., to support and stabilize the beach pole 10. In the example, of a 6-foot-tall beach pole 10, the support parts 26-32 may each be 8 inches long and the support parts 36, 38 may each be 4 inches long. When combined with the T adaptors 40, 42, 44, this makes the support base 14, 19 inches long by 14.5 inches wide. Other lengths of the components of the support base 14 may be used, giving due consideration to the competing factors of providing sufficient stability and keeping the support base small enough to be sufficiently lightweight and easily transported.

As shown in FIG. 3, the lower piece 16*b* is releasably connected to the support base 14 with an adaptor 46. Specifically, affixed at the bottom of the lower piece 16*b* is a male adaptor 50*a* with an external threaded fitting 50*b*. The T adaptor 40 in the center of the support piece 34 functions as a mating female adaptor 52*a* with an internal threaded fitting 52*b*. The adaptor 50*a* of the lower piece 16*b* can be connected to the adaptor 52*a* of the support piece 34 to assemble the beach pole 10, and can be disconnected from the adaptor 52*a* to disassemble the beach pole 10.

Figure 5A:
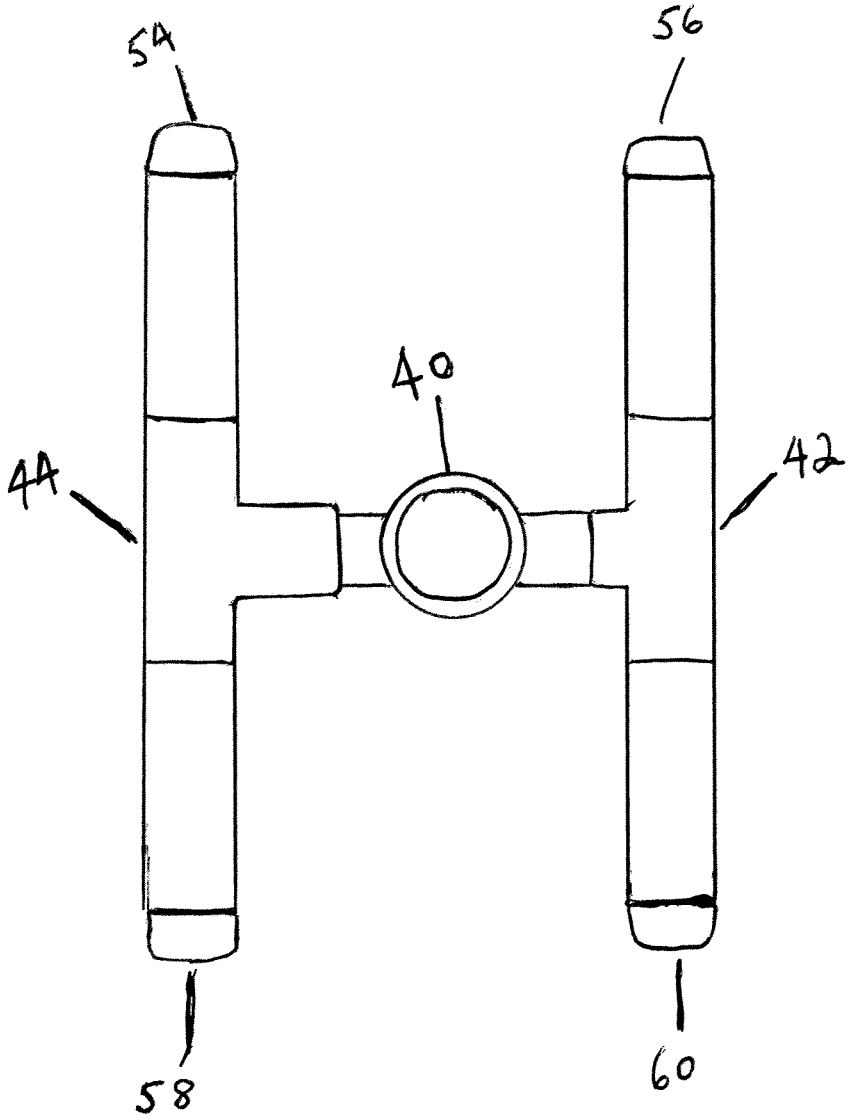
FIG. 5A is an elevational view of the support base.
Figure 5B:
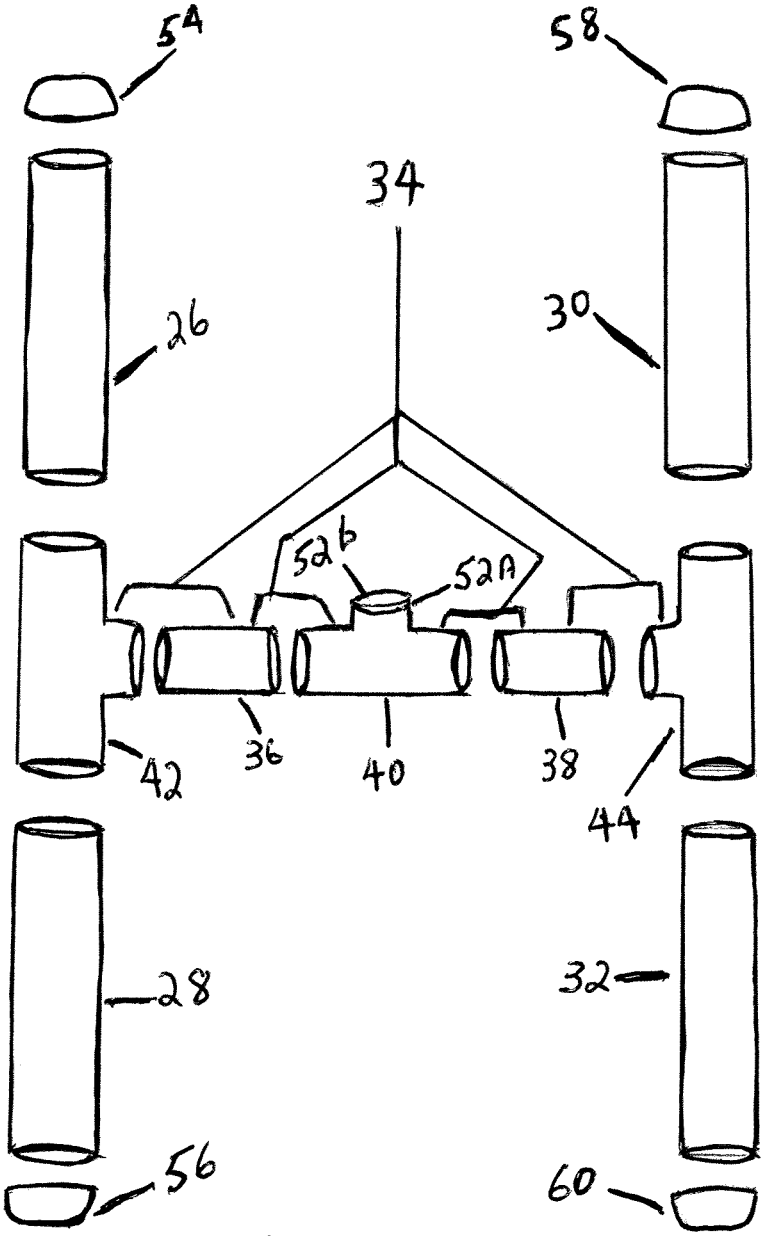
FIG. 5B is an exploded view of the support base.
Figure 6:
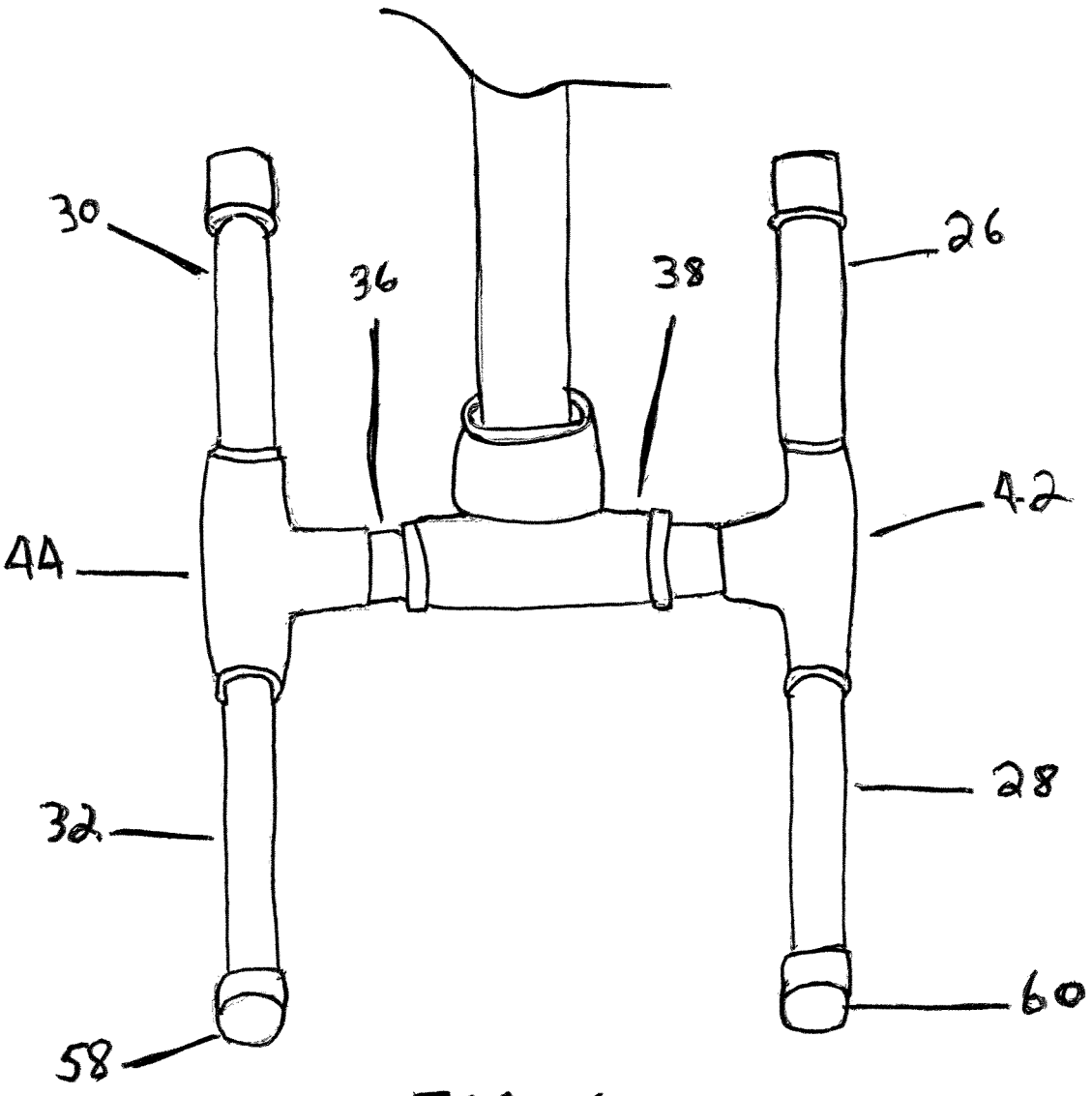
FIG. 6 is an elevational view of the support base when connected to the pole.

As shown in FIGS. 2, 5B, 6, each end of the support parts 28-32 is closed with the respective cap 54, 56, 58, 60.

Thus, in this embodiment, the support base 14 is formed of 13 components: 4 caps, 4 pieces of 8 inch piping, 2 pieces of 4 inch piping, 2 T adaptors each to join 3 piping pieces, and 1 T adaptor with a threaded inner fitting to join the 2 support piping pieces to the lower piping piece 16*b*.

Each upper and lower piece 16*a*, 16*b* and support parts 26-32, 36-38 may advantageously have an interior diameter of 1 inch and an exterior diameter of 1.5 inches. The adaptors are appropriately sized to fit the dimension of the poling.

In manufacturing the beach pole 10, each component, e.g., pipe, support part, cap, and adaptor, may be made of PVC piping or other elements suitably weather resistant and suitably lightweight to be easily transportable. When using PVC elements, each such component may be cleaned with a PVC purple primer which cleans the PVC piping before applying PVC cement glue to permanently affix components together where appropriate.

The beach pole 10 may be decorated in any desired way to be festive and attractive, while remaining weather resistant.

The materials of the pole 12 and the support base 14 may be considered in conjunction with the size of each component and the anticipated load so that the beach pole 10 will stand sturdily erect when assembled, with or without a load, with the support pieces 26-32, 36-38 all substantially lying flat on the surface of the beach. With this design of the pole 12 and the support base 14, there is no need to dig a hole in the sand in order for the beach pole 10, to stand erect, or to provide any further supporting elements. It is only necessary to smooth a small area of sand to provide a relatively small surface for the support base 14 to go under the sand. If desired, for instance, on a very windy day, the support base 14 may be buried in the sand to provide additional stability. Advantageously, the pole may include a sand line above the support base 14 indicating a depth to which the support base 14 should be buried.

In addition, with this design, the beach pole 10 can be erected on any relatively flat surface, such as the deck of a boat, deck of a pool and concrete. For such uses, suction cups at the bottom of the support base 14 may be added to provide additional stability. The beach pole 10 thus combines convenient storage with movability.

As shown above, the pole 12 is divided into separable pieces 16*a*, 16*b*, and the support base 14 is separable from the pole 12. An advantageous result of this structure is that the components may be easily transported, as compared with a 6 foot or taller pole, especially with an attached perpendicular base. The shorter pieces may fit conveniently into a bag for carrying and into the trunk of a car for driving to the beach. In addition, the pieces may be divided up between two or more people for even easier carrying. However, the entire beach pole 10 is advantageously light enough with not much physical strength required for one person to carry the entire structure.

In an alternative embodiment, the upper and lower pieces 16*a*, 16*b*, may be relatively foldable, e.g., by being connected with a hinge, to provide a smaller carrying length. The support base 14 may be correspondingly foldable with respect to the lower piece 16*b*.

It will be understood that the present invention has been described and illustrated in the figures above purely by way of example. However, the invention is not limited to the described embodiments, and many other embodiments of the invention are possible without departing from the basic concept of the invention. Each feature disclosed in the description and, where appropriate, in the claims and/or drawings may be provided independently or in any appropriate combination.

The invention claimed is:

1. A support pole comprising:

a pole, said pole having a longitudinal length that is separable into a plurality of successive pole pieces in order along said length, wherein said plurality of successive pole pieces comprises at least an upper pole piece and a lower pole piece, wherein said pole can be assembled by connecting said plurality of successive pole pieces in order from said upper pole piece to said lower pole piece, wherein each pole piece is connected to an adjacent pole piece by a respective threaded fitting, wherein said upper pole piece has a cap directly connected to an upper distal end, thereby closing off said upper distal end;

a plurality of hooks connected to said pole and extending outward therefrom, said hooks being adapted to receive and support individual loads and wherein each of said hooks is foldable against said pole; and a support base, wherein said support base is H-shaped and comprises:

a first side and a second side each formed of two parallel support legs, each support leg comprising two support pieces connected by a T adaptor such that the support pieces are axially aligned, wherein a distal end of each support piece is closed with a respective cap, and wherein a third end of each T adaptor is permanently connected to first and second ends of a central support such that each support leg is substantially perpendicular to said central support;

wherein said central support is formed of two central support pieces permanently connected to a central T adaptor such that they are axially aligned, wherein the two central support pieces comprise the respective first and second ends of the central support, wherein an upper end of said central support of said support base is removably connected to said lower pole piece through an internal threaded fitting;

wherein said support base is configured to rest on an external horizontal flat surface, wherein, when said pole is assembled by connecting said plurality of successive pole pieces in order and when said support base is connected to said lower pole pieces, said support pole is standable with said support base resting on the external horizontal flat surface; and wherein said pole and said support base are constructed from a PVC piping material, such that the support pole is resistant to corrosion from sand and salt.

2. The support pole according to claim 1, wherein said longitudinal length is approximately six feet long.

3. The support pole according to claim 2, wherein said upper and lower pole pieces are of approximately equal length.

4. The support pole according to claim 1, wherein said upper and lower pole pieces are of approximately equal length.

5. The support pole according to claim 1, wherein said hooks are connected to said upper pole piece.

6. The support pole according to claim 1, wherein each pole piece has a length of approximately three feet.

7. The support pole according to claim 1, wherein materials of said pole and said support base are configured such that said support pole stands sturdily erect on said support base when assembled.

8. The support pole according to claim 1, wherein materials of said pole and said support base are configured such that said support pole stands sturdily erect on said support base when assembled and bearing a load.

9. The support pole according to claim 1, wherein the support pole supports a load from at least one of said hooks that is formed of one or more of the following items: clothing, beach towels, toys, food/beverage bags and beach bags.

10. The support pole according to claim 1, wherein, when said pole is assembled by connecting said plurality of successive pole pieces in order and when said support base is connected to said lower pole piece, said support pole is standable on an external flat surface of sand.

11. The support pole according to claim 1, wherein said hooks are arranged in a plurality of vertically spaced rows.

* * * * *